US005388498A

United States Patent [19]

Dent et al.

[11] Patent Number: 5,388,498

[45] Date of Patent: Feb. 14, 1995

[54] APPARATUS FOR BRAIDING A THREE-DIMENSIONAL BRAID STRUCTURE

[75] Inventors: Robin Dent, Foxboro; Donald J. Rose, Sharon, both of Mass.

[73] Assignee: Albany International Corp., Albany, N.Y.

[21] Appl. No.: 961,885

[22] PCT Filed: Jul. 9, 1991

[86] PCT No.: PCT/GB91/01125

§ 371 Date: Jan. 6, 1993

§ 102(e) Date: Jan. 6, 1993

[87] PCT Pub. No.: WO92/01103

PCT Pub. Date: Jan. 23, 1992

Related U.S. Application Data

[63] Continuation-in-part of Ser. No. 551,266, Jul. 12, 1990, abandoned.

[30] Foreign Application Priority Data

Mar. 25, 1991 [GB] United Kingdom ..... 9106348

[51] Int. Cl.[6] ..... D04C 3/22

[52] U.S. Cl. ..... 87/50

[58] Field of Search ..... 87/14, 15, 16, 17, 20, 87/21, 22, 28, 30, 33, 37, 38, 42, 50, 62

[56] References Cited

U.S. PATENT DOCUMENTS

| | | | |
|---|---|---|---|
| 949,245 | 2/1910 | Orthmann | 87/37 X |
| 971,403 | 9/1910 | Rahm | 87/16 |
| 1,104,777 | 7/1914 | Cobb . | |
| 1,104,778 | 7/1914 | Cobb . | |
| 2,018,596 | 10/1935 | Blaisdell . | |
| 3,426,804 | 2/1969 | Bluck . | |
| 4,312,261 | 1/1982 | Florentine . | |
| 4,615,256 | 10/1986 | Fukuta et al. . | |
| 4,621,560 | 11/1986 | Brown et al. | 87/8 |
| 4,719,837 | 1/1988 | McConnell et al. | 87/1 |
| 4,753,150 | 6/1988 | Brown | 87/33 |
| 5,067,525 | 11/1991 | Tsuzuki et al. . | |

FOREIGN PATENT DOCUMENTS

| | | | |
|---|---|---|---|
| 171317 | 5/1952 | Austria | 87/33 |
| 0113196 | 7/1984 | European Pat. Off. . | |
| 0243119 | 10/1987 | European Pat. Off. . | |
| 341442 | 11/1989 | European Pat. Off. | 87/33 |
| 405241 | 10/1924 | Germany . | |
| 2-259147 | 10/1990 | Japan . | |
| 2-264055 | 10/1990 | Japan . | |
| 201611 | 7/1923 | United Kingdom | 87/50 |
| 724604 | 2/1955 | United Kingdom . | |

*Primary Examiner*—Joseph J. Hail, III

*Attorney, Agent, or Firm*—Kane Dalsimer Sullivan Kurucz Levy Eisele & Richard

[57] ABSTRACT

A braiding machine for braiding a three-dimensional braid formed of interlocked layers includes a plurality of yarn carriers with packages of yarn, tracks defining serpentine paths and a drive mechanism for driving the carriers along the paths. The drive mechanism includes a two-dimensional array of braiding horn-gears arranged in rows. At the ends of each rows turnaround horn gears are provided for turning the carriers around. Advantageously, a small turnaround horngear is provided at one end of each row and two turnaround horngears are provided at the other end, each horngear having less number of slots than the braiding horngears.

10 Claims, 9 Drawing Sheets

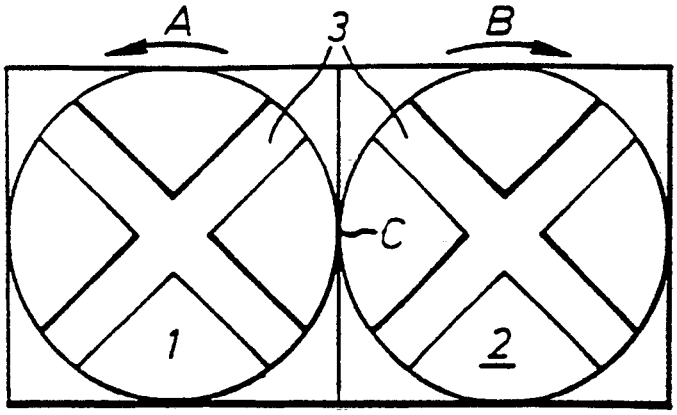
Fig. 1.
PRIOR ART
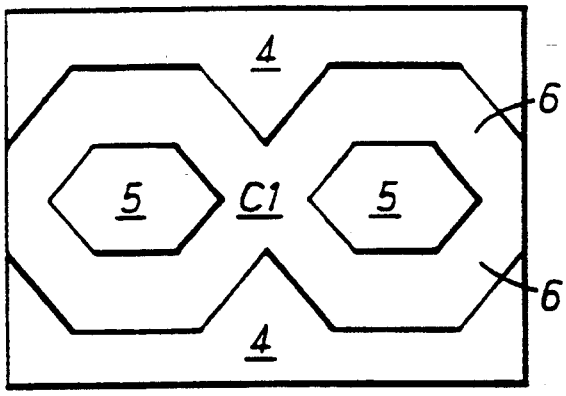
Fig. 2.
PRIOR ART
Fig. 3.
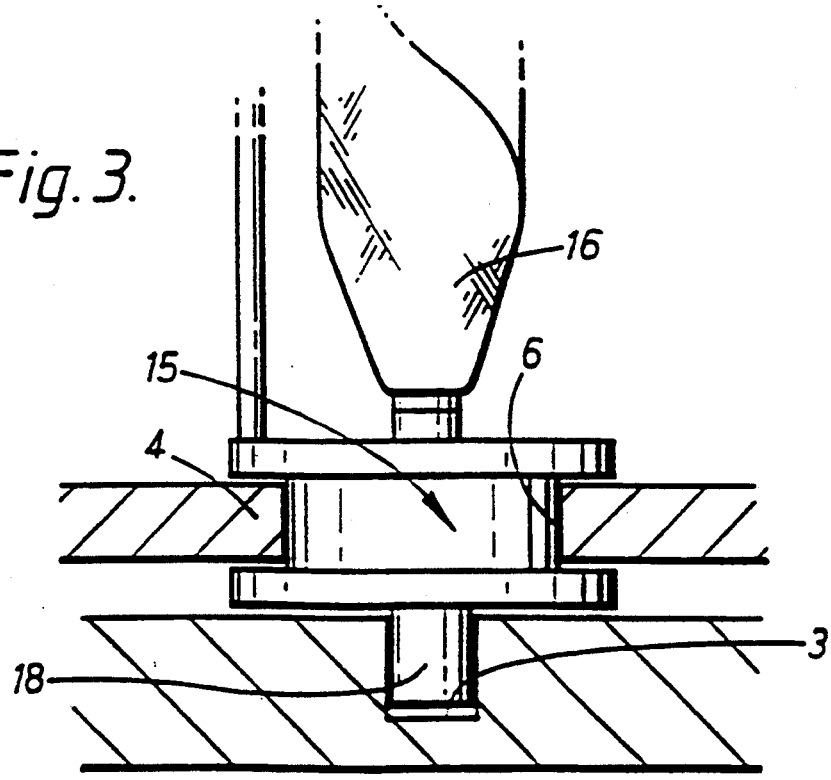

APPARATUS FOR BRAIDING A THREE-DIMENSIONAL BRAID STRUCTURE

This application is a continuation-in-part of U.S. patent application Ser. No. 551,266, filed Jul. 12, 1990, now abandoned.

BACKGROUND OF THE INVENTION

1. Field of the Invention

This invention relates to a method and apparatus for producing a three-dimensional braid structure, such as a multi-layer braid structure, and to a structure produced by such a method and apparatus.

2. Description of the Prior Art

Braided structures are increasingly being used in industry to provide strong, lightweight and non-metallic components. Particular industries requiring such braided structures are the automobile industry and the aircraft industry. The advantage of a braided structure is that such a structure has good tensile strength in all directions as compared with a woven structure which has a relatively limited tensile strength in directions other than those in the direction of the weft and the warp of the yarns comprising the structure.

In order to fit in with industrial requirements, there is a need to provide braid structures in a complex form, that is to say in a form with a cross-section other than that of a simple rectangle or tube, or a moderate variation therefrom. Typical complex forms which are required are forms having, for example, I, J or C cross-sections. Attempts to form such cross-sections in braiding apparatus have previously not been particularly successful since, at any area where there is a re-entrant portion, the yarns of the braid tend to span the entrance and hence defeat the form being sought after.

In other complex forms of structure which do not have re-entrant portions, such as ones sought to have relatively sharp corners or edges, there is a tendency for the braid as laid to be unduly tensioned over the corner or edge and for the braid to open so that the resultant braided structure does not have a uniform strength throughout.

Braided structures are usually of two forms either flat or circular. From "Braiding and Braiding Machines" by W. A. Douglas which was published in 1964 by Centrex Publishing Company, Eindhoven, we know those created in a flat form may be produced in braiding apparatus having a plurality of serpentine tracks and package carriers of yarn which travel the tracks whereby they follow serpentine paths, interbraiding the yarn dispensed by carriers as they do so. At the ends of the paths the carriers are reversed in their direction.

According to US-A-4312261, a traditional way of forming a multi-layer braided structure consists of stacking multiple layers on top of one another and bonding them together, but such structures have virtually no strength in a direction perpendicular to the layers and are liable to fail due to separation or delamination of the layers.

Referring again to "Braiding and Braiding Machines", a braid of a generally tubular cross-section, e.g. circular, may be produced using braiding apparatus in which serpentine tracks are defined in a closed ring and the braid is formed in an area of access of the ring. The yarn package carriers traverse round the serpentine tracks of the ring to follow serpentine paths and lay down the tubular braid as it progresses through the apparatus.

The braid may be formed over a mandrel and this may be of a cross-section other than circular to a limited degree. Multilayer braided structures have been proposed where radial yarns project from a mandrel and the package carriers of yarn weave their yarn around the radial yarns. Such structures have been difficult to manufacture. A novel and improved method and apparatus for constructing a multilayer braid of flat or hollow form where the various layers are interwoven one with the other during the manufacturing process is described in pending U.S. patent application Ser. No. 501043 dated 29 Mar. 1990 and International Patent Application PCT/GB91/00002. The present invention develops the idea of the multilayer structure described in those patent applications.

One proposal which has been made previously to form complex braid structures is that the structure should be developed as a series of components which are then joined together. As a C structure can effectively be constituted of three simple straight structures which are joined at the comers for example by stitching or enveloping in a woven sleeve, the whole can be impregnated if necessary to make a composite braided structure.

Where mandrels are used to create braided structures and a whole range of structures are required there is a disadvantage that a different type of mandrel is required for each size or variation of shape. This considerably increases tooling and production costs. Hence it is obviously advantageous if the range of mandrels required can be substantially reduced in size or eliminated.

In order to overcome the delamination problem and to increase the strength of the structure in a direction which would be at an angle to a layer of a multi-layer structure, it is proposed in US-A-4312261 that a three -dimensional structure be formed by braiding wherein strands extend at an angle to a plane as well as in that plane. That is achieved by releasably maintaining package carriers of yarn in a matrix to form a carrier plane and providing means which effect movement of the carriers along predetermined paths relative to each other in the carrier plane to intertwine the yarn, the movement being effected by moving selected rows and columns along their length by predetermined distances, one after another so that individual carriers are moved in a sequence of discrete steps in mutually perpendicular directions. That is necessarily a slow process and the apparatus must be complex.

OBJECTIVES AND SUMMARY OF THE INVENTION

It is thus desirable to provide a faster method of producing a three-dimensional braid structure which similarly overcomes the problems of delamination and strength at an angle to a layer of a multi-layer structure. A subsidiary object is to seek ways of producing a wide range of braided complex forms, as well as simple forms, in a cost effective manner which does not require complex or expensive apparatus and in which the apparatus is able to be adapted swiftly from the manufacture of one complex form to another.

According to one aspect of this invention there is provided a method of producing a three-dimensional braid structure comprising strands of interbraided yarn including yarn which extends in a direction which is at an angle to a general plane of other strands of the interbraided yarn, in which yarn is supplied to a braiding station from a plurality of package carriers which are constrained to move along predetermined paths relative to each other so that the yarn supplied is interlaced to form the braid structure, wherein the predetermined paths comprise a plurality of serpentine paths whereby the yarns from the carriers moving along a juxtaposed pair of the paths form a braid layer associated with that pair of paths; and in that at least two braid layers are formed simultaneously, being laid down one on top of the other, and package carriers moving along one of the serpentine paths with which one of said at least two braid layers is associated are caused to cross over and move along another serpentine path with which another of said at least two braid layers is associated whereby to produce a yarn interlock between said one braid layer and the other braid layer.

A method in which this invention is embodied will be faster than that taught by US-A-4312261 because it is possible for the carriers whose yarn is to be intertwined to be moved at the same time.

Preferably said at least two braid layers that are formed simultaneously are laid down one on top of another so that each braid layer and the next adjacent braid layer are contiguous.

The package carriers may be moved from the adjacent serpentine path at the next adjacent crossover path back to the original serpentine path, and a package carrier may travel in the adjacent serpentine path for only a minimum distance before returning to the original serpentine path.

A plurality of yarn carriers may be caused to travel the serpentine paths in spaced relationship to each other at the same time. The number of package carriers in any one path at the same time is substantially constant. The number of package carriers in any one path is substantially the same as the number of package carriers in the immediately adjacent path.

At least three parallel serpentine paths may be provided and the package carriers may be constrained to travel in each serpentine path. A package carrier in a first serpentine path may be constrained to travel into the immediately adjacent serpentine path and then into the next adjacent serpentine path; alternatively a package carrier may be constrained to pass from a central serpentine path to each of the serpentine paths on either side thereof. Preferably the package carriers are constrained to return to the first serpentine path before one circuit of their movement is completed.

The package carriers may be constrained at the end of each serpentine path to reverse their direction and to follow a substantially parallel serpentine path to the original serpentine path to interbraid the yarns of package carriers traversing the paths to form a flat braid structure. Alternatively the track module means may be arranged in a continual circuit to form a cylinder and in which the package carriers are constrained to follow a circular path to form a circular braid structure.

The resultant braid structure may be of an irregular form and the method may include assembling a plurality of track modules each defining a part of a serpentine path, in a configuration equating to the irregular form of structure to be created and causing the package carriers to traverse serpentine paths created by the track module means to create the irregular form of braid structure. A crossover path may be provided on one side only of a track module or on both sides of a track module. The track modules may be arranged such that no crossover path occurs at the extremity of the assembly of the modules and the yarn carriers are not constrained to move at an angle to the general direction of part of the serpentine path formed by the respective modules at the extremities.

A plurality of static package carriers may be provided and yarn may be dispensed from these static carriers to be interbraided with yarn dispensed from the movable package carriers.

According to another aspect of the present invention there is provided three dimensional braid structure producing apparatus for the production of a three-dimensional braid structure comprising strands of interbraided yarn including yarn which extends in a direction which is at an angle to a general plane of other strands of interbraided yarn, the apparatus comprising a braiding station, a plurality of yarn package carriers operable to supply yarn to the braiding station, means constraining the yarn package carriers to move along predetermined paths relative to each other, and drive means operable to effect movement of said yarn package carriers along said predetermined paths whereby to effect interlacing of yarns supplied by the yarn package carriers to the braiding station to form the braid structure, wherein said drive means comprise a two dimensional array of intermeshed horngears operatively associated with said yarn package carriers for moving them along said predetermined paths and driving means for driving said array, and said constraining means comprise track means overlaying said array and defining said predetermined paths as a plurality of serpentine paths which extend generally in one direction and correspond to a respective braid layer in said structure, and crossover path means extending in a second direction between one serpentine path and the next adjacent serpentine path to cause or allow package carriers to move between adjacent serpentine paths to effect interbraiding of yarns between adjacent layers.

Each package carrier is adapted to dispense yarn as it moves in a manner well-known in the art, to build up a braid at the braiding station.

The two-dimensional array of rotatable horn gears is preferably represented in modules of 4×2 blocks of gears, the gears of each module being arranged in a rectangular formation and each gear intermeshing with the adjacent gears.

Preferably there is a separate track module associated with each gear module, although one track module may be associated with a plurality of gear modules.

A track module may have a crossover path section on one side only or may have a crossover path section on both sides to effect an "out module changeover" as defined hereinafter. There may be one or a plurality of crossover path sections and out module changeovers in each track module and the track modules can be assembled so as to permit a variety of configurations of serpentine paths to be constructed.

A base board may be provided on which a plurality of gear modules can be arranged in infinite array and over which the track modules are positioned. The base board may also include means for incorporating turnaround gear arrangements at the ends of a serpentine path to enable the flat interbraided braid structure to be completed. Alternatively, the base board may be of a circular form so that a hollow tubular braided structure can be constructed. The base board may itself be or follow the internal surface of a cylinder and the yarns dispensed by each of the carriers may converge at a braiding station located at or in the region of the cylinder axis.

In a variation the track modules may selectively be provided with package carriers for dispensing yarn in an axial direction.

According to a further aspect of this invention there is provided a three-dimensional braid structure comprising strands of interbraided yarn including yarn which extends in a direction which is at an angle to a general plane of other strands of the interbraided yarn, wherein it comprises a plurality of interlocked layers arranged one on top of another in which yarn in each layer follows a plurality of longitudinally extending serpentine paths, the yarns extending in a first direction to define a longitudinally extending path corresponding to a first layer of the braid structure and in a second direction to follow a crossover path between adjacent serpentine paths to interlock with the braid of an adjacent layer. Preferably each layer and the next adjacent layer are contiguous.

An example of the application of the method and apparatus and modifications thereof incorporated in the invention will now be described with reference to the accompanying drawings.

BRIEF DESCRIPTION OF THE DRAWINGS

In the drawings FIGS. 1, 2, 3 and 4 are illustrative of existing, conventional apparatus and techniques in which:

FIG. 1 shows a drive module of a conventional braider;

FIG. 2 shows a corresponding track module for the drive module of FIG. 1;

FIG. 3 is a sectioned fragment showing a yarn package carrier engaged in a slot of the drive module shown in FIG. 1 and with a serpentine path of the track module shown in FIG. 2;

FIG. 4 shows an array of the drive and track modules of FIGS. 1 and 2 for a length of braider to create a single layer of braid;

FIG. 11*i* shows a module combination which does not use the interlacing method of the invention but which can be incorporated in certain applications and variations of the invention, a respective block schematic design structure being shown on the right hand side of each of the track module combinations;

FIGS. 1, 2, 3 and 4 show the principles employed in a conventional apparatus for creating a flat braid. Such apparatus uses a method of braiding which produces a single layer and, if a multiple layer structure is to be provided, then a number of the layers are laid down one on top of the other.

DETAILED DESCRIPTION OF THE INVENTION

Figure 4:
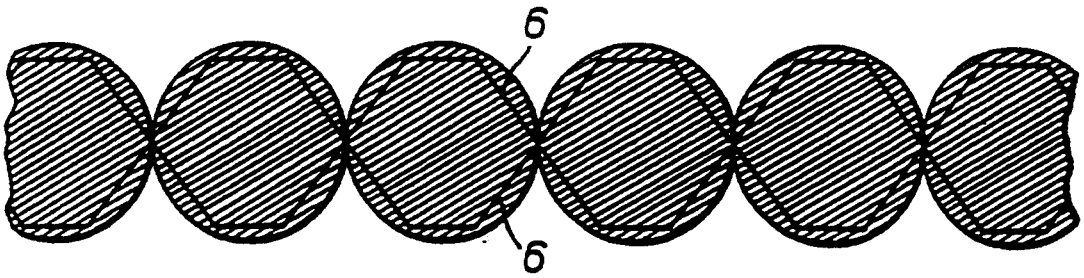

A basic conventional braiding apparatus comprises a track which defines a pair of serpentine paths 6 (see FIG. 2) along which package carriers 15 (see FIG. 3) carrying filaments 16 of the yarn material being braided travel to interbraid the filaments 16. The package carriers 15 are caused to travel along the serpentine paths 6 by engagement of a member 18 depending through the tracks from each package carrier 15, which member 18 is engaged in slots 3 in a rotating gear 1, 2 situated below the track. The slotted gears 1, 2 are known as horngears. There is a plurality of such gears 1, 2 each of which is intermeshed and which are usually driven by a common drive and adjacent gears 1, 2 are rotated in opposite directions.

A typical drive module and gear arrangement is shown in FIG. 1 where two gear wheels 1 and 2 are shown to be intermeshed and the indication of their direction of rotation is shown by the arrows A,B. Each gear wheel 1,2 has respective slots 3 which receive the depending member 18 of a yarn package carrier 15 and which, as the respective gear 1, 2 rotates in the direction of the arrows A or B, causes the yarn package to move along a serpentine path 6 defined by the track superimposed over the gear 1, 2. Depending on the layout of the track there will be a transfer of the package carrier 15 between gears 1 and 2 at the point such as C where the two gears 1 and 2 intermesh and the slots 3 coincide and are aligned. If reference is also made to FIG. 2 it will be seen that the corresponding track module comprises two end plates 4 and two central quoits 5, suitably supported above the gear wheels 1 and 2. The plates 4 and quoits 5 are separated by the serpentine paths 6.

The track module is positioned directly above the drive module of FIG. 1 and the centre of each quoit 5 is coincident with the centre of rotation of the respective gear wheel 1, 2. Thus at the point C of the drive module it will be seen that there is a coincidence with the crossover point of the two serpentine tracks 6 and this is indicated as C1 on the track module.

Depending on the width of each layer of braid to be manufactured, a plurality of track and drive modules are arranged in tandem so as to give a linear array as shown in indicative form in FIG. 4. At the end of the array (not shown) there is no transfer and a package carrier continues fully around the quoit 5 of the last track module which is specially shaped to transfer from one serpentine path 6 to the other. This will be explained further with reference to FIG. 8. Thus as the package carriers traverse along the serpentine paths 6, the filaments are continuously interbraided and a layer of flat braid is built up.

Since each layer made using the apparatus of FIGS. 1 to 4 is independent of an adjacent layer it is necessary, according to the known arc, in order to build up a firm braid structure for separate interlacing of the layers to take place. However, it is preferable, in order to make a strong braid structure, to interlace the layers securely during manufacture.

This can be done by modifying the principles of the apparatus of FIGS. 1 to 3 to create at least two layers of material simultaneously and to ensure that the filaments from the package carriers of each layer travel out of the serpentine path of that layer into the serpentine path of the adjacent layer. The apparatus in which the invention is embodied requires a basic novel combination of drive modules and track modules, as is shown for example in FIGS. 5 and 7 to which reference is now made, in order to produce an interlocked multilayer braid structure.

Figure 5:
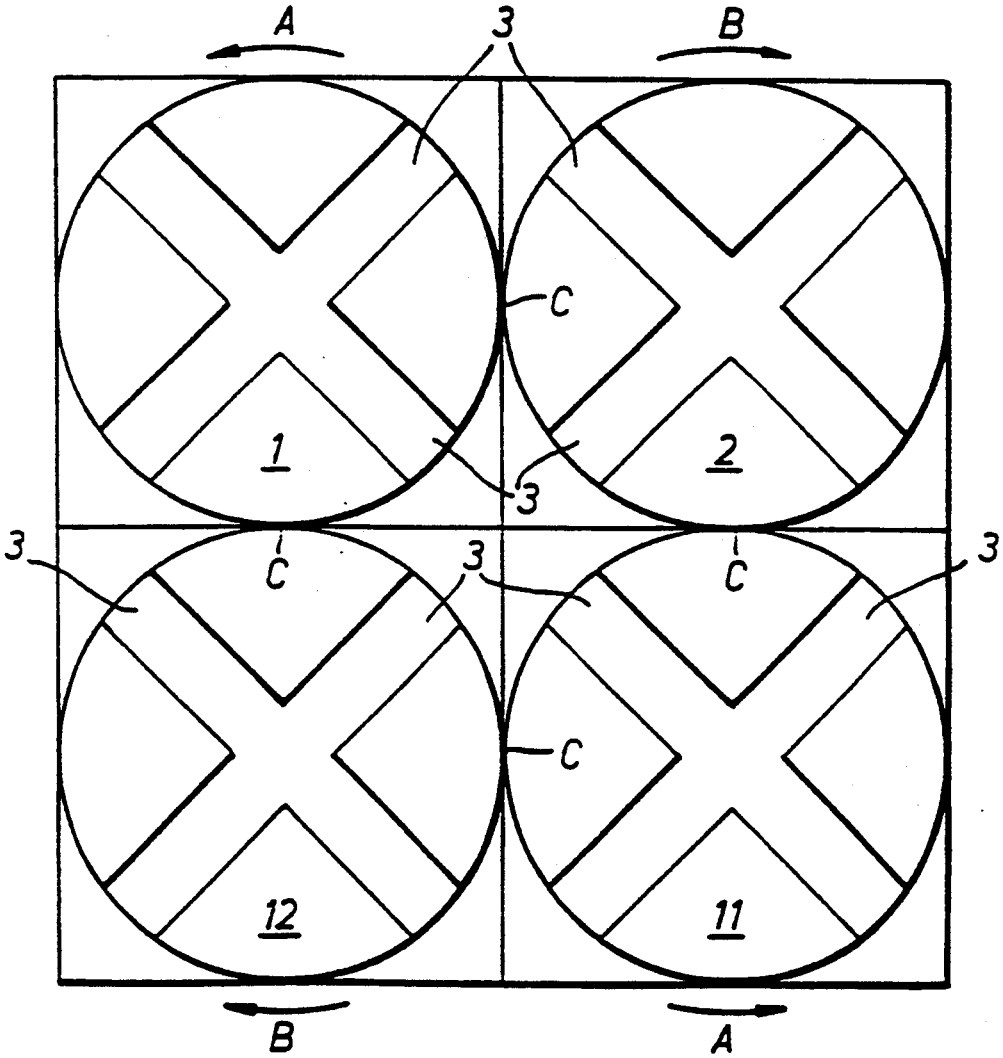
FIG. 5 shows a drive module of apparatus in which the invention is embodied.
Figure 6:
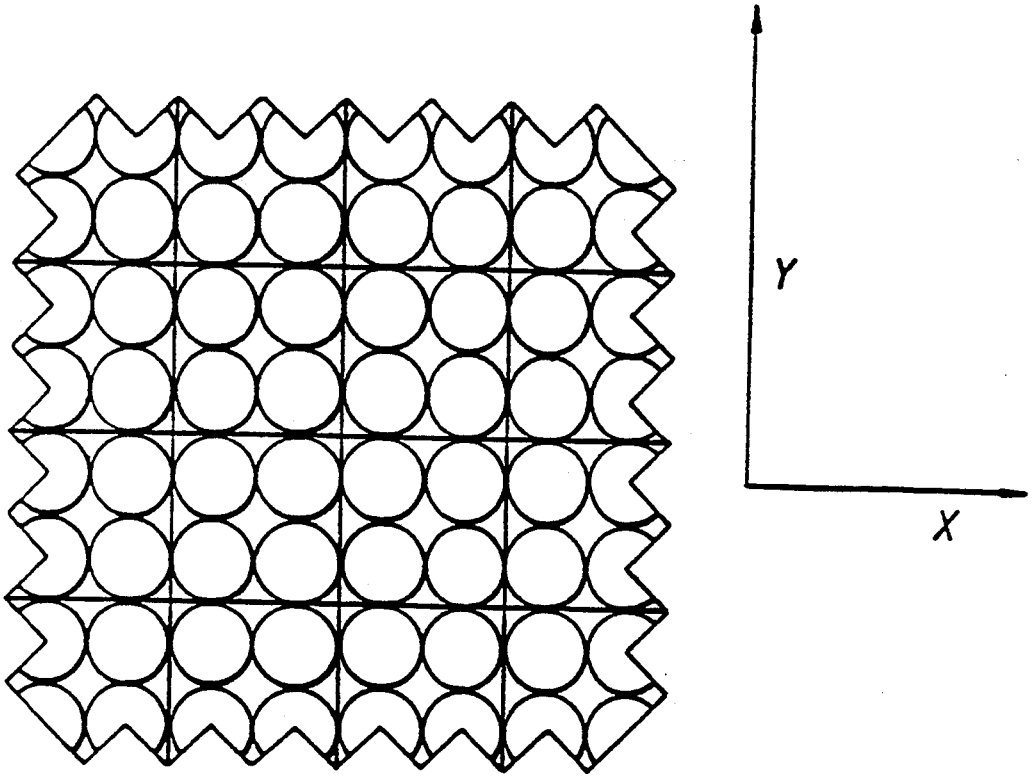
FIG. 6 illustrates assembly of a plurality of the drive modules of FIG. 5 as part of a generic infinite array.

In FIG. 5 the original gear wheels 1 and 2 are supplemented by further gear wheels 11 and 12 and each gear wheel has four slots 3 corresponding to the slots 3 of FIG. 1. The four gear wheels are arranged in a block with each gear wheel intermeshing with the two immediately adjacent gear wheels and the directions of rotation are as indicated as before by the arrows A,B in FIG. 5. A plurality of these modules can be arranged in any configuration and FIG. 6 shows schematically part of a generic infinite array of drive modules. All the drive modules in FIG. 6 are identical with those shown in FIG. 5.

Figure 7:
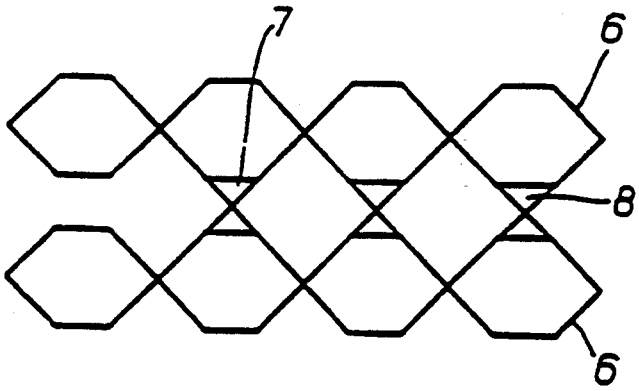
FIG. 7 diagrammatically illustrates a track module of apparatus in which the invention is embodied.

In combination with each pair of drive modules of FIG. 5 it is necessary to incorporate a track module and the layout of a suitable track module is shown in FIG. 7. The track module of FIG. 7 is such that the package carriers move during one complete traverse of each serpentine path between the two layers being simultaneously laid down. At the areas 7 and 8 there are crossover points which are indicated by the notation of a horizontal line in the Figure. A study of FIG. 7 shows that there are effectively two circuits superimposed on each other and as the package carriers are caused to progress about these circuits defined by the track modules, the filaments of yarn from each carrier will braid in a first layer and then be carried into the adjacent layer to interbraid with the filaments in that layer before returning to the original layer. The modules of FIGS. 5 and 7 indicate the essence of the invention and from which a large number of variations of interlaced braid structures can be derived.

Figure 8:
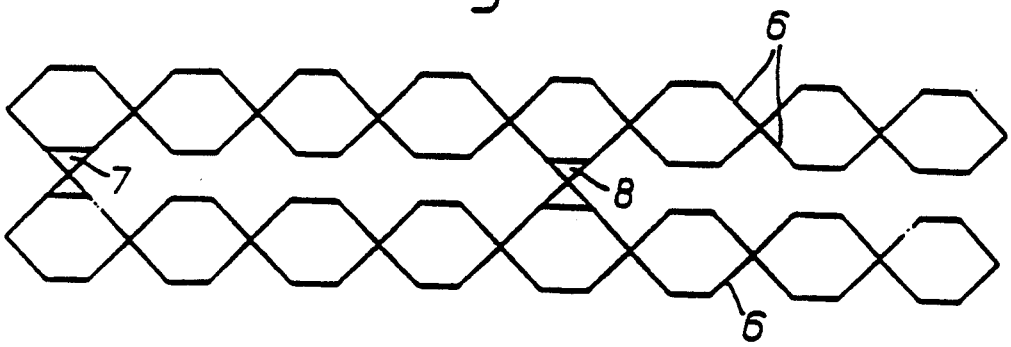
FIG. 8 diagrammatically illustrates a track module similar to that illustrated in FIG. 7 which has a reduced crossover density as compared with that illustrated in FIG. 7.

In FIG. 8 a variation of the basic track module shown in FIG. 7 is illustrated and this is only one of several variations which can be achieved. The track module of FIG. 8 does not require the interlacing yarn to travel into the adjacent layer as frequently as the module of FIG. 7. FIG. 7 indicates apparatus which allows the maximum amount of interlacing possible, whereas with the track module of FIG. 8, a reduced amount of interlacing is obtained which is, in fact, half that of FIG. 7. It will be appreciated that there are a number of variations of the track modules and that whilst in FIG. 7 there are eight gear wheels to each track module, in FIG. 8 there are sixteen gear wheels to each track module.

Figure 9:
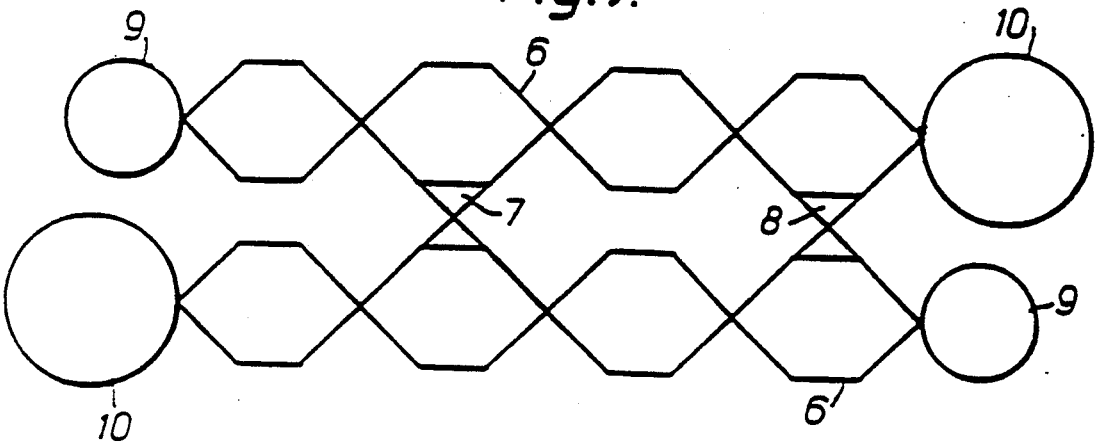
FIG. 9 diagrammatically illustrates the track module of FIG. 7 with turnaround features.

With a basic track module as shown in FIG. 7 a very narrow braid can be created. Generally there would be a number of such modules arranged in tandem but for the most simple case, the braiding apparatus would be set up as shown in FIG. 9, to which reference is now made, with turnaround gear wheels 9,10 at the end of each serpentine path 6. These gear wheels would have either one less or one more slots than the number of slots in the gear wheels 1, 2, 11, 12. Thus in FIG. 9 the turnaround gear wheels 9 have three slots, whereas the turnaround gear wheels 10 have five slots. The turnaround wheels have a special configured circular track module associated with them to cause the package carrier to complete a loop at the end of each row of track modules.

Figure 10:
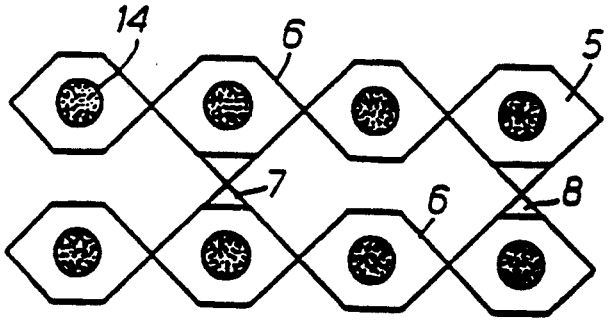
FIG. 10 illustrates a modification of apparatus in which this invention is embodied whereby axial yarns are incorporated into a braided layer.

It is possible to create a module which has reinforcing yarn filaments which are laid in the direction of manufacture of the flat braid. If the package carriers are considered to move in an X and Y direction, as indicated in FIG. 6, the reinforcing filaments would be in the z direction out of the plane of the paper and at right angles thereto. In this case, the filaments are dispensed from stationary package carriers located at the centre of the central quoits 5 of the track modules. This is shown in FIG. 10 where the reinforcing or axial filaments are shown at 14.

It has been stated above that there are a number of variations of track modules. In fact, in practice, a single module of the type described with reference to FIG. 7 would only have limited application and therefore it is necessary, in order to take maximum advantage of the invention, to produce a set of modules which are capable of assembly together in a variety of combinations to provide a wide range of interlocked multilayer braid structures. With certain exceptions, it is necessary that each of the modules should have the ability of creating two adjacent layers of braid which are interlocked together. This means that the serpentine paths must be such that a package carrier creating one layer travels from its original path to the path of the adjacent or contiguous layer and then back to the path in the original layer. In doing this it provides an interlock of the yarn between the two layers and the more often that the package carrier transfers between the layers, the stronger the interlock becomes.

In this example each module of a set will include two gear modules and one track module. The gear module will have four gears in the X direction and two gears in the Y direction.

The modules of FIGS. 7 and 8 so far described work well to provide interlocking between two adjacent layers where the layers are created by one track module or a line of similar modules. It is necessary in building up a large structure of some depth for other layers also to be interlocked to the original layers. Thus if a plurality of modules are arranged to create a structure having more than two layers it is necessary that the modules are configured so that the package carriers travel from one module into the next module and back to the original module at crossover points. Hereinafter, where this occurs reference will be made to an "out-module changeover" and where the crossover between layers occurs within the module it will be referred to as an "in-module changeover".

Figure 11:
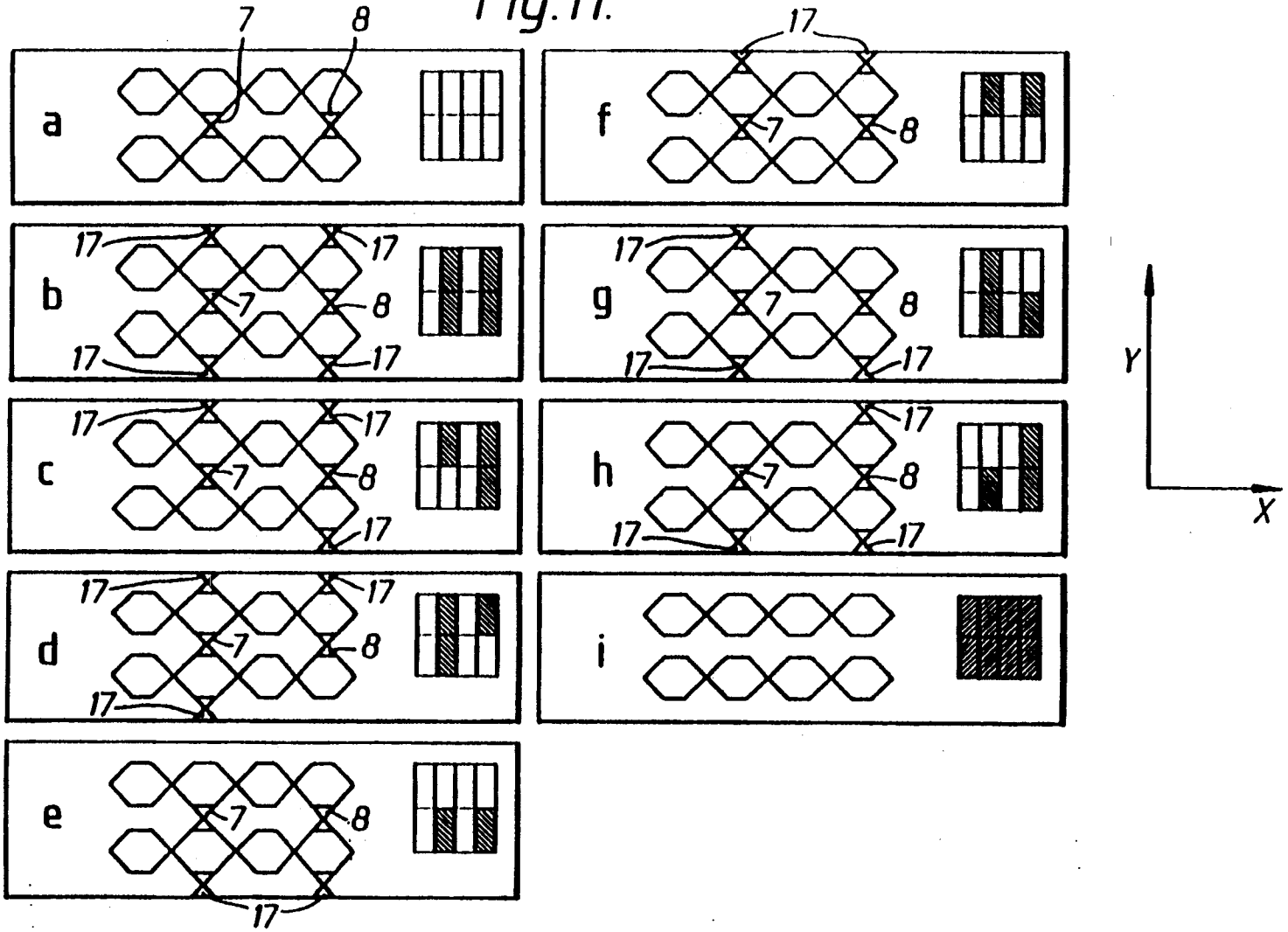
FIG. 11 illustrates, in FIGS. 11*a* to FIG. 11*h*, eight variations of track module combinations which can be used in carrying out the invention to achieve different lacing patterns and interlocking sequences between layers.

Referring now to FIG. 11, this Figure shows the serpentine paths of a set of track modules all based on the configuration of two gear modules as shown in FIG. 5, i.e. the gears are arranged in two rows of four beneath the corresponding track module. These are the simplest and the basic combinations from which a wide range of composite braided interlocked structures can be built. To the right of the serpentine paths is shown a module notation. It will be understood that there is a limit to the number of package carriers that can be travelling along the serpentine paths of a track module at any one time as there can be only one package carrier at a transfer point between two intermeshing gears and that, in order to avoid package carriers travelling in opposite directions around the same turnaround gear at the same time, there should be only one package carrier engaged with a turnaround gear at any one time. There are certain complex shapes of a flat braid structure where it is desirable to use track modules which extend over sixteen horngears arranged 4×4, in order to have one package carrier per cycle of a serpentine path and to avoid there being two package carriers engaged with the same turnaround gear at the same time and travelling in opposite directions, which could not work, otherwise a smaller number of package carriers with a greater spacing between them would have to be used. This design point should be borne in mind when reading the following description which, for the sake of convenience, is directed to the smaller modules including eight horngears, arranged 4×2 but which can be assembled in pairs to comprise a 4×4 module arrangement.

In FIG. 11*a* the basic track module described with reference to FIG. 8 is illustrated and the notation to the right shows eight blank areas. It will be noted that there are two in-module changeover points 7, 8 and thus it is only possible with this track module to create two layers of interlocked braided material and it is not possible to take the package carriers out of the serpentine paths defined by the module into adjacent layers.

However, in FIGS. 11*b* to 11*h* out-module changeover is possible. In these Figures each of the transfer points at which out-module changeover occurs is referred to by the reference 17 and wherever an out-module changeover occurs in the module notation, the transfer is indicated by a hatching. Thus in FIG. 11*b* it is possible to obtain two out-module changeovers in the layer above the module and also in the layer below the module. Thus the track module of FIG. 11*b* would be useful as a track module in a thick braided structure where it is used as an intermediate rather than an edge module.

In FIG. 11*c* the module has two out-module changeovers above the track module and one below, to the right-hand side. The notation in the block diagram indicates this. This type of module is very useful where a shaped braid structure is being constructed and can be used as an internal corner point.

FIG. 11*d* is similar to FIG. 11*c* except that the out-module changeover is at the left, below the module, rather than the right.

In FIG. 11*e* a track module is shown which is useful in application in constructing an edge layer of a module. There are no out-module changeovers at the top of the track module, but two at the bottom. The converse of this is shown in FIG. 11*f* where there are two out-module changeovers at the top of the track module and none at the bottom.

FIGS. 11*g* and 11*h* are converse track modules of FIGS. 11*d* and 11*c* respectively and both have two out-module changeovers at their bottom, but only one at their top, FIG. 11*g* being at the left and FIG. 11*h* on the right. These are noted in the block module notation.

The track module of FIG. 11*i* is not suitable for use as a single track module in apparatus for carrying out the invention but is in accordance with the prior art. This module may, however, be used in combination with one or more of the track modules which are appropriate for use in carrying out the invention. It will be noted that the track module in FIG. 11*i* has no in-module nor out-module changeover points and thus the layers produced will not be interlocked. The block module notation used for this is shown with hatching in the opposite direction to the hatching shown in FIGS. 11*b* to 11*b*.

It will be appreciated that an almost infinite array of modules can be produced building up on the principles shown in FIG. 11. For example, the module illustrated earlier and described with reference to FIG. 8 would, instead of having two gear modules, have four gear modules so that there are eight gears in each row and there are two rows. This concept can be expressed empirically for the modules as 2N×2 where N is an integer with a value of at least two. There is theoretically no upper value to N. Again, as discussed above, it may be desirable to provide a basic module comprising one track module over four gear modules arranged in four rows with four gears in each row which could be expressed empirically as 2N×4. Attention is drawn to the fact that each track module represents a repeat of a given serpentine path configuration. This implies that the Y position of a movable package carrier is the same at the beginning and the ending X position for any particular track module configuration.

The layout of track modules to create typical braid structures will now be illustrated by way of example. The module notations to be constructed are as indicated in FIG. 11. The modules will be referred to by the letters a to i.

Figure 12:
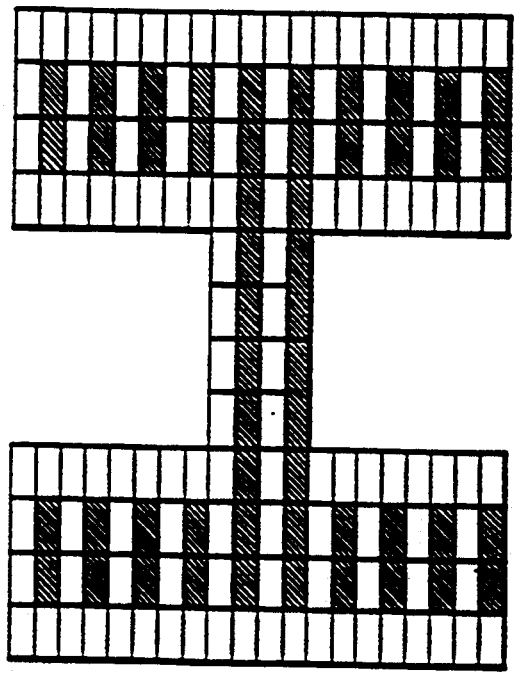
FIG. 12 shows a typical combination of the block schematic design structures shown in FIG. 11 arranged to form an I shaped interlaced braid structure.
Figure 13:
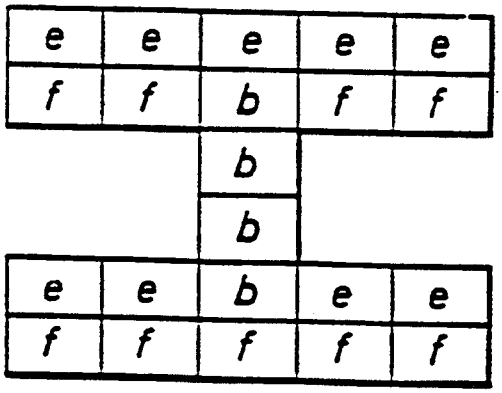
FIG. 13 indicates the specific layout of track module combinations shown in FIG. 11 that form the I structure of FIG. 12.
Figure 14:
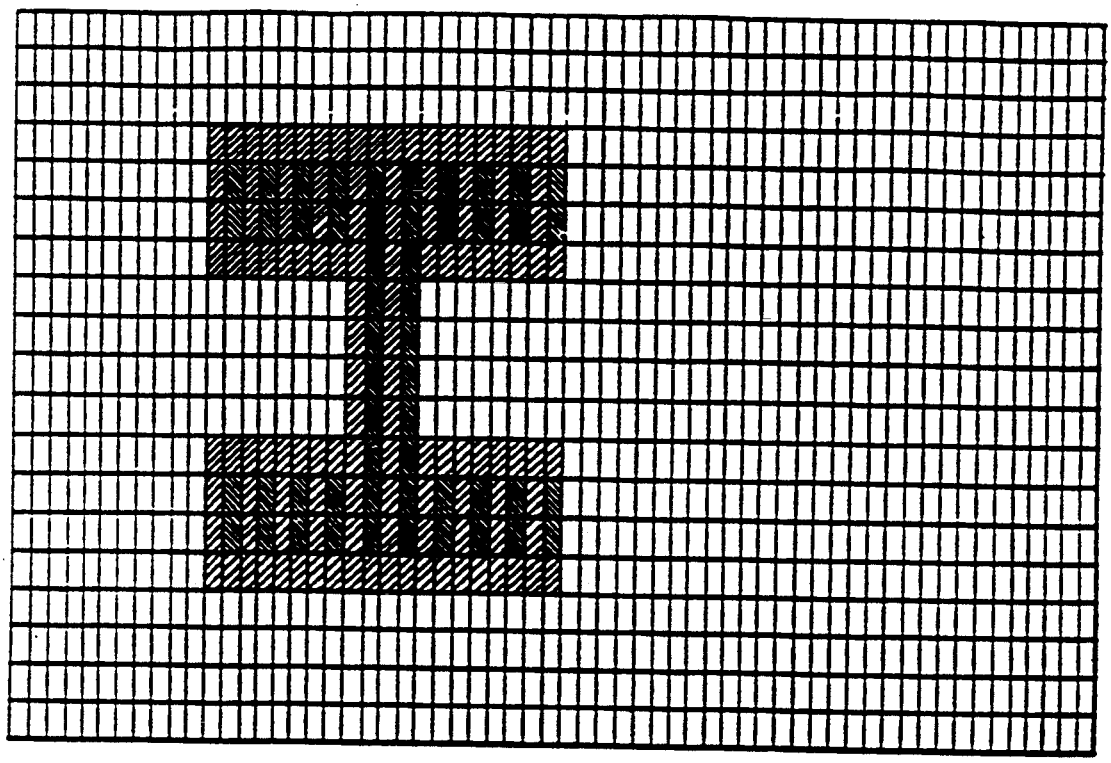
FIG. 14 indicates how the modules would be set out on a universal drive bed to braid up the I structure of FIG. 12.

The first shape to be constructed will be the I configuration as is shown in FIG. 12. The track modules will be assembled arranged as shown in FIG. 13 and disposed over respective gear modules on a base as shown in FIG. 14. In FIG. 13 the individual track modules are referred to by the letters of FIG. 11. It should be noted that the boundary or edge modules e and f are used at the top and bottom of the braid structure and also that the central span of the I shape extends over two modules. Of course, the actual number of modules used to form the top, the bottom and/or the stem of the I shape is a matter of design choice. For example the I-stem may extend over four modules. However, the out-module changeovers of adjacent modules must, of course, be coincident to enable the interlacing which is required to take place so that the required changeover of package carriers between paths takes place.

Thus considering FIGS. 12, 13, 14 and 15 it will be seen that the top layer of modules of the top limb of the I structure are all e modules to produce a top edge or boundary surface. In the second layer of modules from the top, starting from left to right, the module f is selected for the first two modules so that there are two out-module changeovers above each of them but none below them so that below each of those modules there is a clean edge. The next module b requires two out-module changeover paths to cooperate with the module e above it and the module b below it. The other two modules are module f which has no out-module changeovers at the lower boundary surface and this results in a braid structure which presents an un-interlocked bottom layer but strong interlocking at two out-module changeovers with the contiguous module e.

The stem of the I comprises two vertical modules b which interlock at the second and fourth positions.

In the lower limb of the I structure the bottom layer is constructed with f modules so that a lower edge or boundary surface with no out-module changeover is presented. The outer two modules of the upper layer of the lower limb, on either side of the stem are e modules again to secure the boundary edge with no out-module changeovers on the top side and in order to ensure interlocking on one side only, whereas the central module is a b module interlocking with the f module on one side and the b module on the other.

Figure 15:
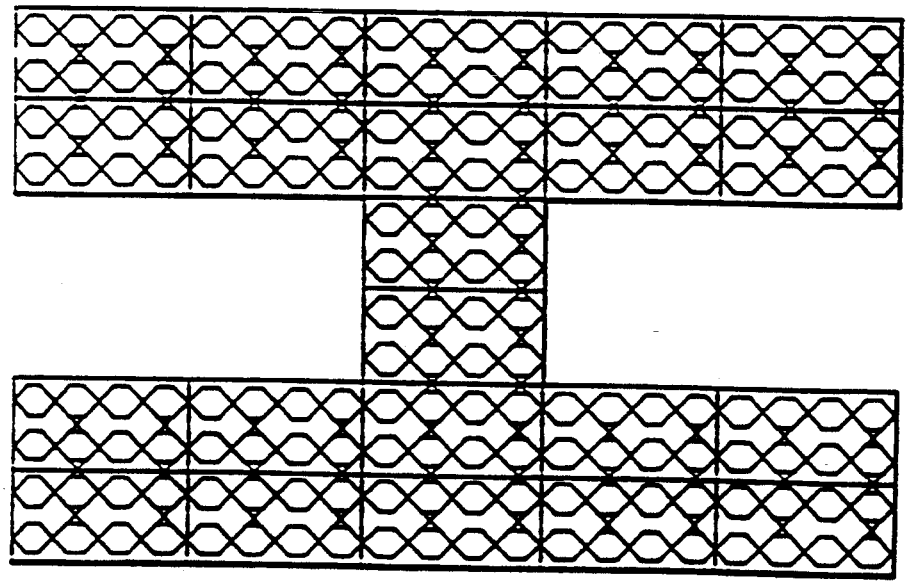
FIG. 15 sets out the path patterns of the track module combination arrangement of FIG. 14.

FIG. 15 shows the serpentine paths for the I structure of FIG. 14, there being two out-module changeovers between each juxtaposed pair of modules and two in-module changeovers in each module which results in a strongly interlocked braid structure.

By use of this configuration of modules a braided structure is able to be formed in which each layer is fully interlocked with the next layer and no external connections between layers have to be applied. Furthermore, each open edge of the layers are sealed and there are no stray ends of filaments.

Figure 16:
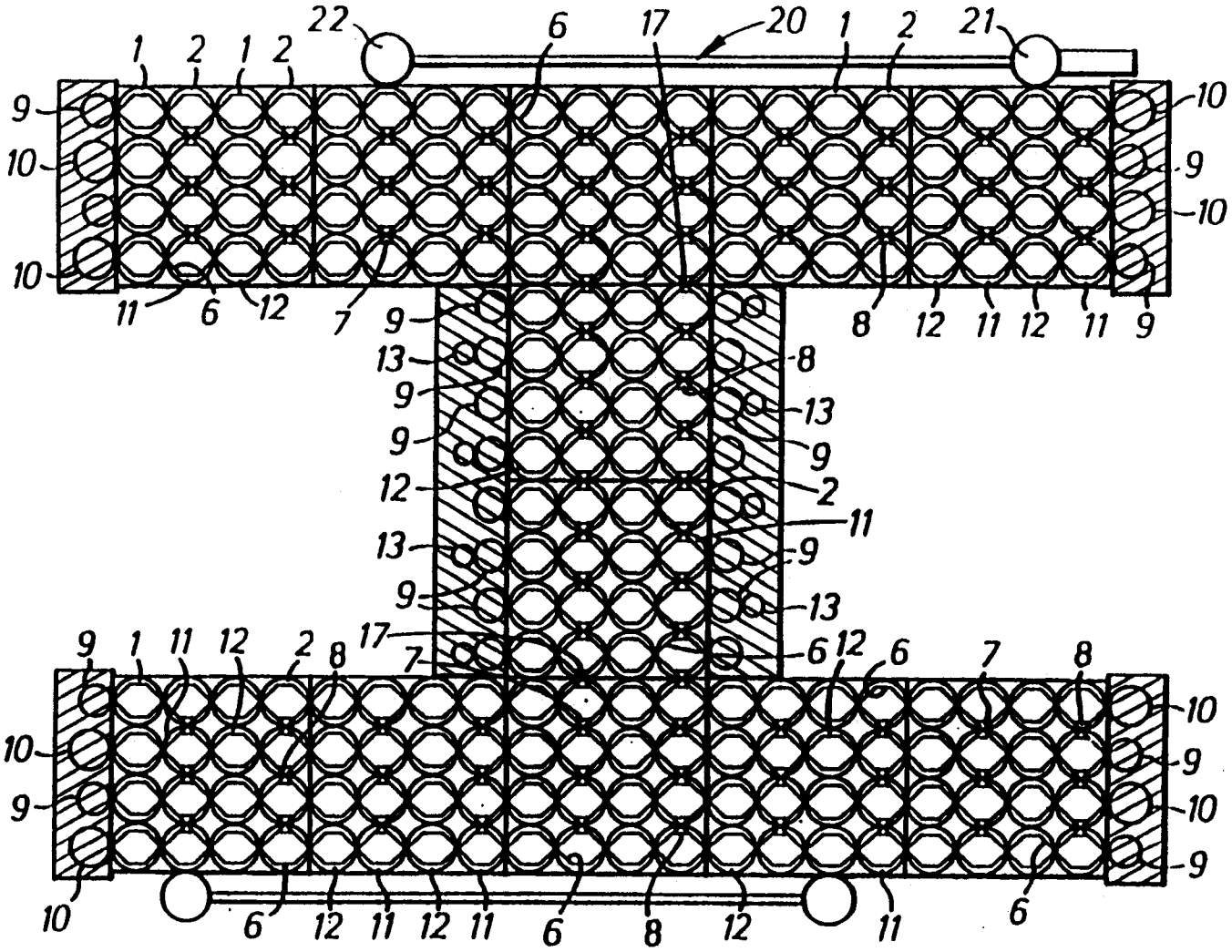
FIG. 16 shows a two-dimensional array of intermeshed rotatable horn gears with turnaround gearing to form an I structure superimposed on path patterns similar to those shown in FIG. 15.

FIG. 16 shows diagrammatically an assembly of track modules arranged for forming an I-structure braid, the assembly being similar to that shown in FIG. 15. The gear modules that are under the track modules are also shown diagrammatically in FIG. 16. The array of slotted gear wheels, or horngears 1, 2, 11 and 12, shown in FIG. 16 comprise 16 rows of horngears, the middle 8 rows being shorter in that they have less columns than the other rows and being disposed symmetrically relative to them. There is a common drive arrangement 20 including a prime mover 21, and a drive gear 22 which meshes with one, 2 of the horngears 1 and 2 of one of the outer, longer rows of the array. The longer rows of the array comprise a row of 20 horngears 1 and 2 or 11 and 12, each having four slots 3 which are arranged in a cruciform pattern, and a turnaround horngear 9, 10 at either end. The arrangement is substantially as is described with reference to FIG. 9 so that the turnaround horngear 10 at one end of each of the outer, longer rows has 5 equiangularly spaced slots 3 and is adjacent a turnaround horngear 9 having 3 equiangularly spaced slots 3 which is at the adjacent end of the juxtaposed longer row, whilst the turnaround gear 9 at the other end of each outer, longer row has 3 equiangularly spaced slots and is adjacent a turnaround gear 10 having 5 equiangularly spaced sloes 3 which is at the adjacent end of the juxtaposed longer row. The arcuate distance around the perimeter of each horngear 1, 2, 11, 12 and of each turnaround horngear 9, 10, between the radially outer ends of each juxtaposed pair of slots 3 of each of those gears 1, 2, 11, 12 is the same. Each of those horngears 1, 2, 9, 10, 11, 12, is orientated so that each slot 3 of any one of those horngears 1, 2, 8, 9, 11, 12, is aligned with a slot 3 of a horngear 1, 2, 8, 9, 11, 12, with which it is intermeshed, at the point of meshing between them, to allow for transfer of a package carrier from one horngear 1, 2, 8, 9, 11, 12, to another, along the appropriate path, at that point of meshing.

The shorter rows of the array comprise a row of 4 horngears 1 and 2, 11 and 12, each having four slots 3 which are arranged in a cruciform pattern and turnaround gearing an either end. There is not enough space to accommodate a turnaround horngear 10 having 5 equiangularly spaced slots 3 at either end of either of the shorter rows. To overcome that problem whilst a turnaround horngear 9 having 3 slots 3 is provided at one end of one of the shorter rows and at the other end of a juxtaposed shorter row, two intermeshed horngears 9 and 13 in tandem are provided at the end of each of the shorter rows remote from the turnaround horngear 9 having three sloes just mentioned. Each of the two horngears 9 and 13 in tandem comprises a turnaround horngear 9 having 3 slots 3 which meshes with the adjacent horngear 1, 11, having 4 slots 3 which is at the respective end of the respective shorter row, and another horngear 13 having two, diametrically opposed sloes 3.

In operation of the array of horngears 1, 2, 8, 9, 11, 12, 13, described above with reference to FIG. 16, each of the turnaround horngears 9 having 3 slots 3 advances a package carrier it turns around, by one quarter of a turn of a horngear 1, 2, 11, 12, having four slots 3 relative to a series of package carriers transferred by the horngears 1, 2, 11, 12, having 4 slots 3 along the respective path pattern. On the other hand, each of the horngears 10 having 5 slots 3 delays a package carrier it turns around, by one quarter of a turn of a horngear 1, 2, 11, 12, having four slots 3, relative to the series of package carriers transferred by the horngears 1, 2, 11, 12, having 4 slots 3 along the respective path pattern. Each pair of gears 9 and 13 in tandem comprising a turnaround horngear 9 having 3 slots 3 and another horngear 13 having just 2 slots 3, has the same delaying effect as a turnaround horngear 10 having 5 slots. That is because, although the turnaround horn gear 9 having 3 slots 3 advances the package carrier it turns around, by one quarter of a turn of a horngear 1, 2, 11, 12, having 4 slots 3 as it transfers the package carrier to and fro between the respective turnaround horngear 13 having 2 slots 3 and the respective shorter row, that other horngear 13 having 2 slots 3 delays that package carrier by half a turn of a horngear 1, 2, 11, 12 having 4 slots. The same end result occurs if the turnaround gear 13 having 2 slots is between the turnaround gear 9 having 3 slots and the respective shorter row.

A pair of intermeshed horngears 9 and 13 in tandem may be used instead of the larger horngear 10 which has five slots, even at the end of the longer row where there would be room for the latter.

In practice, the braiding apparatus would comprise a universal drive bed as is shown in FIG. 14 upon which the gear modules would be assembled according to the configuration required and according to the size required. In the example given in FIG. 14, the track module layout is illustrated which is positioned above the necessary gear modules. It will be noted that in this example, only part of the drive bed is used and thus it is possible on one drive bed to set up not only a structure of an I configuration of different dimensions, but also to set up other configurations. One such an alternative configuration is shown in FIG. 17, to which reference is now made.

Figure 17:
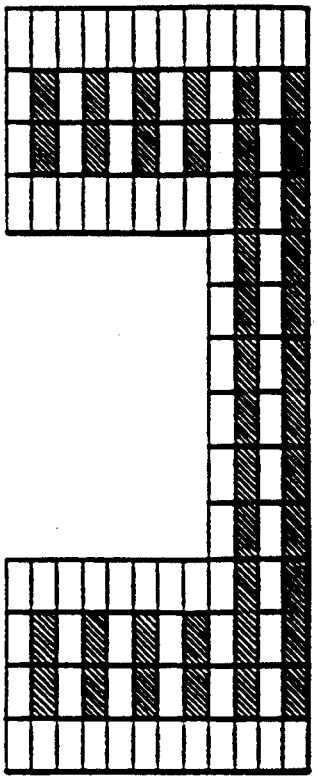
FIGS. 17 and 18 show the layout of block schematic design structure and track module combinations shown in FIG. 11 for a different shape of braider structure, in this case a reversed C.
Figure 18:
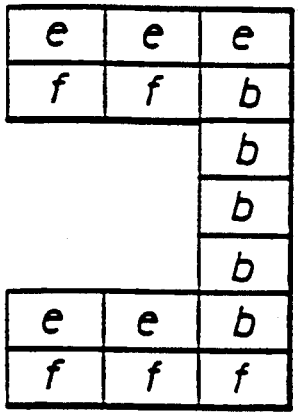

In FIG. 17 a module notation arrangement is shown for making a reversed C braid structure. The track module arrangement necessary is illustrated in FIG. 18. Again the top and the bottom lines of the structure are e and f modules to ensure that there is no out-module changeover at the edges and that the structure formed has a clean top and bottom boundary surface Also, b modules are used to construct the vertical spine layers of the braided structure. This then is a simple arrangement requiring only three different types of module. A turnaround gearing arrangement similar to that used at the lefthand side of the central span of the I-structure shown in FIG. 16 would be used between the uppermost pair of b modules and the adjacent f module and between the lowermost pair of b modules and the adjacent e module, whereas the larger turnaround gear with 5 slots maybe used along the righthand edge of the reversed c-structure shown in FIG. 18.

Figure 19:
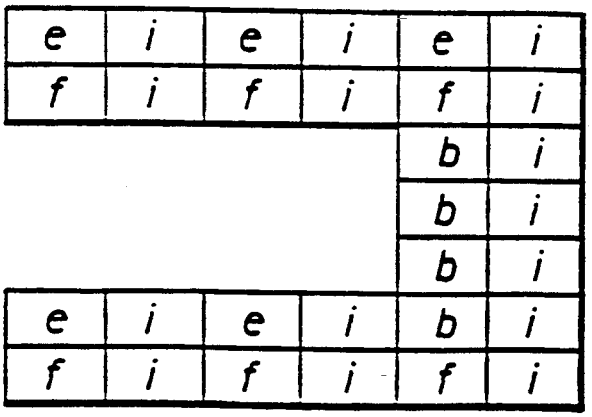
FIG. 19 is a variation of the track module combination layout shown in FIG. 18 comprising a combination of modules using the invention and modules with no interlacing, such as is shown in FIG. 11*i*.

A variation of the reverse c-structure is shown in FIG. 19 where use is also made of the i modules of FIG. 11. This arrangement of modules gives rise to a somewhat looser structure since interlacing will only occur in those areas where modules other than i modules are present.

The invention enables very strong braid structures to be created with interlocked layers; such a structure may be used either on its own or may be impregnated with a resin, for example, to form a composite braid structure. Such a composite braided structure may include yarns impregnated with a resin material. The degree of interbraiding between layers can be varied as has been explained, but for the strongest structure where an out-module changeover takes place at every alternate gear position, be it either the 1st, 3rd, 5th etc. or the 2nd, 4th, 6th etc., an extremely solid structure is obtained merely by the braiding action.

The configuration of braided structures which are fully interlocked are not limited to the I or reverse C structures shown, but may by judicial selection of the track modules be used to create a whole range of interlocked braid structures. The structures are readily extendable in the X direction where no out-module changeover is necessary and selection of the correct track module is only necessary in the Y direction.

If reinforcing elements are used in the Z direction from stationary yarn package carriers in accordance with FIG. 10, then even further strength is added to the final structure.

In view of the large range of structures able to be produced by the correct selection of modules, it is very convenient to use a CADCAM system for designing any configuration of braid structure. A suitable computer program can be written which acknowledges the properties and limitations of each of the modules and it can then take account of information fed to it regarding the- shape, dimension and degree of interlocking required in the final braided structure in order to produce the required layout. The output from any computer into which the computer program is fed can then be used to operate a robotic system which can transfer the modules onto the bed plate of FIG. 14 and load on package carriers, both static and movable, as required and set up the whole system.

The system can further be extended so that the optimum ratio of braider package travelling speed to the braid linear speed for the yarn being used and the angles at which it is delivered can be automated as can the substitution of new packages for exhausted yarn package carriers.

We claim:

1. An apparatus for braiding a three-dimensional braid structure, said apparatus comprising:

a braiding station;

a plurality of yarn package carriers for providing yarn to said braiding station;

track means for defining a plurality of serpentine paths of travel for said carriers; and drive means for effecting movement of said carriers along said paths for interlacing said yarns, said drive means including a plurality of intermeshed braiding horngears arranged in a plurality of rows defined between turnaround devices, each row corresponding to a pair of said paths, said turnaround devices for each said rows including a single first turnaround horngear at one end having a first number of slots, said turnaround devices including at least two second turnaround horngears at the other end of each said row having a different total number of slots than said first turnaround horngear;

wherein said braiding horngears each have n slots, and said turnaround horngears each have less than n slots, said slots being used for moving said carriers;

said track means and drive means cooperating to move said each carrier along a respective row, said carriers being turned around at the end of the rows by said turnaround horngears, with said turnaround horngears receiving one carrier from the respective row and returning said carrier to the same row.

2. Apparatus according to claim 1, wherein said track means comprises a plurality of track modules, said track modules defining said serpentine paths, wherein at least one of said track modules includes a crossover point on one side for crossing one of said carriers between rows.

3. Apparatus according to claim 2 in which a track module has a crossover path section (17) on one side only.

4. Apparatus according to claim 2 in which a track module has a crossover path section (17) on both sides.

5. The apparatus of claim 1 wherein said first turnaround horngear has $n-1$ slots and said second turnaround horngears have a total of $n+1$ slots.

6. The apparatus of claim 5 wherein said one row is adjacent to another row, said another row having a first end adjacent to said one end of said one row and a second end adjacent to said another end of said other row, said first end having another two turnaround horngears with a total of $n+1$ slots, and said second end having another first turnaround horngear with $n-1$ slots.

7. The apparatus of claim 1 wherein said braiding horngears have an even number of slots, and wherein the total number of slots in said turnaround horngears does not exceed twice the number of slots in one of said braiding horngears by an odd number of slots.

8. The apparatus of claim 7 wherein said number of slots in said braiding horngears is four, said first turnaround horngear and one of said two second horn gears have three slots each, and the second of said two second horngears has two slots.

9. The apparatus of claim 1 wherein said two second turnaround horngears are intermeshed and wherein one of said two turnaround horngears is adjacent to one of said braiding horngears.

10. The apparatus of claim 9 wherein said one turnaround horngear of said two second turnaround horngears has more slots than the second of said two second turnaround horngears.

* * * * *